US005461870A

United States Patent [19]

Paradowski

[11] Patent Number: 5,461,870

[45] Date of Patent: Oct. 31, 1995

[54] SELF-REFRIGERATED METHOD OF CRYOGENIC FRACTIONATION AND PURIFICATION OF GAS AND HEAT EXCHANGER FOR CARRYING OUT THE METHOD

[75] Inventor: Henri Paradowski, Cergy Pontoise, France

[73] Assignee: Compagnie Francaise d'Et de Construction-Technip, Courbevoie, France

[21] Appl. No.: 274,179

[22] Filed: Jul. 12, 1994

[30] Foreign Application Priority Data

Jul. 15, 1993 [FR] France ..... 9308695

[51] Int. Cl.[6] ..... F25J 3/00

[52] U.S. Cl. ..... 62/11; 62/36; 62/42; 165/166

[58] Field of Search ..... 62/36, 42, 11; 165/166

[56] References Cited

U.S. PATENT DOCUMENTS

| | | | |
|---|---|---|---|
| 4,228,660 | 10/1980 | Grenier | 62/79 |
| 4,721,164 | 1/1988 | Woodward | 62/36 |
| 5,017,204 | 5/1991 | Gottier et al. | 62/11 |
| 5,122,174 | 6/1992 | Sunder et al | 62/36 |
| 5,144,809 | 9/1992 | Chevalier et al. | 62/36 |
| 5,291,738 | 3/1994 | Waldrop | 165/166 |

FOREIGN PATENT DOCUMENTS

| | | |
|---|---|---|
| 2384221 | 3/1977 | France . |

*Primary Examiner*—Ronald C. Capossela
*Attorney, Agent, or Firm*—Pennie & Edmonds

[57] ABSTRACT

A self-refrigerated method of cryogenic fractionation and purification of gas and a heat exchanger for performing the method, wherein the gaseous fluid is treated in an exchanger forming a unitary assembly: it is partially condensed by cooling in a fifth and first circuits and the non-condensed gaseous fraction is re-heated in a second circuit, the required cold being supplied by the condensates which after having been sub-cooled in a third circuit and expanded in a valve are evaporating in a fourth circuit, the method permitting the purification of a gaseous fluid with several condensable components through cooling possibly in an exchanger with multiple channels for each circuit.

10 Claims, 2 Drawing Sheets

SELF-REFRIGERATED METHOD OF CRYOGENIC FRACTIONATION AND PURIFICATION OF GAS AND HEAT EXCHANGER FOR CARRYING OUT THE METHOD

BACKGROUND OF THE INVENTION

The present invention relates to a method of cryogenic fractionating and purification of gas.

It is also directed to a heat exchanger for carrying out this method.

Some gases comprise at the same time components which are rather easily liquefiable at low temperature and components which are liquefiable with more difficulty or non-liquefiable. It is therefore usual to attempt to separate them by cooling to condensate the easier liquefiable elements and to thus separate them from the components which are liquefiable with more difficulty or non-liquefiable.

Among the gases with several components which may thus be processed may be mixtures of different hydrocarbons or with non hydrocarbonic components such as nitrogen, hydrogen, argon and/or carbon monoxide and for example the gases from catalytic cracking or steam cracking.

To achieve the required cooling, use is made in the prior art of heat exchangers and in particular of reflux exchangers also referred to as "dephlegmators", the external refrigeration being usually supplied in counter-current relationship by a refrigeration cycle or by a dynamic gas expansion. This would limit the use of these techniques to temperatures at which the refrigeration cycles are available and to the cases where the expansion of the effluents for example of hydrogen or methane is possible.

It is also possible to use a self-refrigeration process. The process consists in cooling the gas to be purified in a first exchanger, in separating the non-condensed gas from the first condensate formed, for example in a fractionating column, and further cooling the non condensed gas in a second exchanger to form a second condensate, in separating this second condensate from the non-condensed gas in a separator and to return the second condensate to the column as a reflux.

The non-condensed gas separated from the second condensate constitutes the purified gas. The coolant for both exchangers is constituted by the first condensate which is subjected to a vaporization through expansion and flows successively through the second and then the first exchanger. The purified gas may itself flow through the second and then the first exchanger.

The method and the device according to the invention exhibit the advantage of not requiring as a general rule a refrigeration by means of refrigerants extraneous to the equipment and of not requiring any expansion of that or those component(s), liquefiable with more difficulty, of the treated gaseous mixture. The latter point is important since on the one hand the liquefaction processes most often require the application of a high pressure and on the other hand some separated gases obtained, such for example as hydrogen and/or carbon monoxide often are reagents for chemical reactions which have to be operated under a high pressure. It would therefore not be very economical to expand these gases during the cryogenic separation in order to have then to recompress them.

Furthermore the method and the device according to the invention are more economical than the known self-refrigeration method since they require one unitary exchanger only which is cheaper than the multiple appliances (at least two exchangers, one fractionating column, one separator and many circuits) of the known process. They also would reduce the thermal losses and avoid high expenditures for the insulation of the circuits and apparatus.

The gases to which the invention applies are mixtures of at least two and preferably of at least three different chemical components with different boiling (or condensation) temperatures under the conditions of the method and for example a mixture of hydrogen, of methane and of at least one C2-hydrocarbon such as ethane or ethylene with or without higher (C3 or more) hydrocarbons. Other mixtures in addition include carbon monoxide and/or nitrogen.

The method according to the invention is a self-refrigerated method of cryogenic fractionation and purification of a gaseous feed fluid with at least two components condensable at different condensation temperatures, namely at least one relatively heavy component to be removed and at least one relatively light component to be recovered, respectively, so as to produce a purified gas preferably comprising the relatively light component(s) and a separated gas preferably comprising the relatively heavy component(s), characterized in that it consists in operating in a heat exchange zone forming a unitary assembly and comprising at least five distinct aggregately vertical circuits referred to as the first, the second, the third, the fourth and the fifth circuits, respectively, in indirect heat exchanging relationship with each other at each level of the heat exchange zone, the first circuit or reflux circuit being essentially arranged within an upper and relatively colder portion of the heat exchange zone and the fifth circuit being essentially arranged in a lower and relatively less cold portion of the heat exchange zone, which method comprises the steps of circulating at least one fraction of the gaseous feed fluid aggregately from bottom to top within the fifth circuit under such conditions that it may condense in part to give a first condensate and that this first condensate be carried along without any substantial reflux by the said gaseous fluid, discharging the resulting mixture of non condensed gas and of the first condensate from the top of the fifth circuit, separating the said non condensed gas from the first condensate in a phase separation zone, circulating the gas thus separated aggregately from bottom to top in the first circuit or reflux circuit under such conditions that one part of the gas may give a second condensate and that this second condensate may flow back in the said first circuit and be collected at its bottom, circulating at least one part of the non condensed gas discharged from the top of the first circuit aggregately from top to bottom in the second circuit in counter-current relationship with the fluid circulating in the first circuit and then with the fluid circulating in the fifth circuit, and discharging the resulting purified gas, circulating the first condensate and the second condensate aggregately from bottom to top in at least one third circuit to there undergo a sub-cooling, discharging from the top of the third circuit the resulting sub-cooled first and second condensates, expanding them and circulating them aggregately from top to bottom in at least a fourth circuit where they are vaporized upon taking heat from the fluids of the first, third and fifth circuits, at last discharging the said vaporized condensates from the bottom of the fourth circuit, these vaporized condensates constituting the separated gas.

Thus the invention operates a unitary heat exchanger (a unitary heat exchanging zone) comprising over at least one part of its height, at least five circuits, each one preferably of the multi-channel type, aggregately directed vertically.

One of the circuits called reflux circuit or first circuit is essentially arranged within an upper portion of the exchanger (the exchange zone), i.e. within a relatively colder portion of the exchanger. This preferably is a "non tortuous" circuit, i.e. wherein the condensed liquid may stream in one aggregately downward direction. Another circuit (fifth circuit) preferably of the tortuous kind unfit for liquid reflux is essentially arranged in a lower portion of the exchanger (the exchange zone), i.e. in a relatively less cold portion of the exchanger.

With an aggregately vertically directed circuit of the non tortuous type is meant a circuit such that the fluid, which is fed thereinto at the bottom, may flow forward in a general manner from bottom to top without any substantial reflux of the liquid portions of this fluid, whereby there is supposed to be for example a smaller mean slope or gradient than in the aforesaid reflux circuit; in other words, all or almost all of the (liquid and gaseous) fluid will follow an aggregately upward directed path in this circuit of the tortuous kind and will be collected at the top of the said circuit, the discharge point (or zone) being located in an intermediate portion of the heat exchanger, for example in the vicinity of the first third or of the half-height of the exchanger.

It is preferable that the aforesaid tortuous circuit be entirely or almost entirely at a lower level than the reflux circuit and still better that both circuits be arranged substantially above each other in the exchanger.

The second, third and fourth circuits may either be or not be tortuous, preferably non-tortuous.

It is however not indispensable to use a tortuous circuit and a non-tortuous circuit to achieve the results (reflux and non reflux, respectively), referred to hereinabove. One may indeed act upon the cross-section of the circuit and/or the flow velocity of the feed fluid in this circuit. A low speed within a relatively wide channel permits the reflux indeed whereas at a high speed within a relatively narrow channel results in the condensate being carried along thereby preventing it from flowing back. A multi-channel circuit with a small cross-section and a great flow velocity therefore is advantageous in particular for the fifth circuit. The five aforesaid circuits are in heat exchanging relationship with one another at each level of the exchanger where they are present, thereby assuming that the exchanger is preferably made from a good heat conducting material with walls with the smallest possible thickness compatible with the strength of the materials and comprising a large exchange surface. Those skilled in the art will be able to make such exchangers without any difficulty from the foregoing statements.

SUMMARY OF THE INVENTION

According to the invention, the aforesaid multi-component gaseous fluid (with at least two and preferably at least three condensable components) is caused to circulate from bottom to top within the fifth circuit located in a lower portion of the exchanger under temperature and pressure conditions such that it may condense in part without flowing back into the said circuit. The mixture of gas and liquid (first condensate) taken from the top of the fifth circuit is separated into a gaseous phase and a liquid phase in a separation zone. The resulting gaseous phase is caused to circulate from bottom to top within the first circuit (reflux circuit) preferably located above the fifth circuit as stated hereinabove. Within this relatively cold portion of the exchanger, one part of the gas would condense and the condensate (second condensate) would flow downward again towards the aforesaid separation zone, and this in view of the non-tortuous character of this first circuit or of the low upward speed of the gas.

The second condensate thus formed may be mixed with the first condensate already present within the separation zone or be recovered separately. The non-condensed gas recovered at the top of the first circuit is carried back into the exchanger by the aforesaid second circuit to circulate therein from top to bottom in counter-current relationship with the fluids circulating in the first circuit and in the fifth circuit. It flows out again in a re-heated condition thereby constituting the purified gas formed of the most volatile elements of the gaseous feed fluid.

The liquid phase of the separation zone consisting of the first condensate alone or of the mixture of the first and second condensates is caused to circulate from bottom to top in the aforesaid third circuit where it would undergo a sub-cooling. It is then expanded statically or dynamically and caused to circulate from top to bottom in the aforesaid fourth circuit of the exchanger where it vaporizes owing to the heat taken from the fluids of the tortuous circuit, of the first circuit and of the third circuit. The gaseous stream discharged at the bottom of the fourth circuit includes the least volatile components of the gaseous feed fluid. If desired it may be recycled in part or treated otherwise.

According to an alternative embodiment, it is possible to not mix the first and second condensates and to cause them to separately flow through the third and fourth circuits, thereby accounting for the invention using "at least one third circuit" and "at least one fourth circuit" The method scheme set forth hereinbefore has thus permitted without any supply of cold of external origin to the system, to fractionate a gaseous mixture at low temperature without any appreciable pressure loss for the most volatile components of the batch.

Various modifications or alternative embodiments may be brought to the invention.

According to a first alternative embodiment, only one part of the gaseous phase recovered at the head of the first circuit is conveyed into the second circuit; the other part is expanded and used within the exchanger in the downward direction either through passage into a sixth exchange circuit or preferably through passage into the fourth circuit while being mixed with the expanded liquid phase of the condensate(s) which is fed thereinto to there permit a vaporization at a higher pressure. In this case the production of purified gas under a high pressure is lesser but this is not an inconvenience when one proceeds with a recycling of the gaseous stream issued from the fourth circuit or with a recompression of the gaseous stream from the sixth circuit. Preferably 90% to 98% by mole of the gaseous phase collected at the head of the first circuit are carried to the second circuit and the other part (2% to 10% by mole) is expanded and joined to the said liquid phase of the fourth circuit.

According to another alternative embodiment, one part of the gas to be purified does not flow through the fifth circuit and is directly conveyed to the gas-liquid separation zone or to the first circuit. This permits to adapt the operation of the equipment to the modifications of composition of the batch load. Preferably in this case a fraction of 80% to 95% by mole of the gas passes into the fifth circuit and a fraction of 5% to 20% by mole is conveyed to the separation zone. One may thus maximize the amount of purified gas obtained with the second circuit.

Still another alternative embodiment consists in providing a supply of liquid phase of external origin to the exchanger under conditions where this liquid phase may expand and vaporize after expansion during its passage from top to bottom in the exchanger. This liquid phase of external origin may at first flow through the exchanger from bottom to top through an auxiliary circuit to there undergo a sub-cooling before flowing down again through an auxiliary circuit. This is advantageous during the start of the equipment to facilitate and to accelerate its cooling. More simply if its composition is compatible with that of the liquid of the third circuit, it may be mixed to the latter before the entry thereof into the third circuit or only before the entry of the said liquid into the fourth circuit.

It is advantageous to adjust the condensation rate of the gaseous feed fluid within the fifth circuit to a value of 2% to 20% by mole. The temperature and pressure conditions in the unitary heat exchange zone according to the invention are of course depending of the composition of the feed and the skilled man will be able to select these conditions in each particular case by means of his knowledge, it being essential to operate under conditions permitting a partial condensation of the feed fluid. Due to the fact that this is a cryogenic method, one should operate below the ambient temperature, for example between 0° C. and −150° C. according to the treated gas and the selected pressure. Since there is provided an expansion of the condensates, one advantageously operates at a superatmospheric pressure for example between 5 and 100 bars. One will hereinafter find values given by way of examples.

Owing to a judicious choice of the operating conditions, it will be readily possible to obtain a purified gas including less than 1% by mole of relatively heavy components and a separate gas including at least 30% by mole of the said relatively heavy components.

The invention relates also to a heat exchanger permitting to carry out the method described hereinabove. This exchanger is characterized in that it comprises at least five distinct aggregately vertical circuits referred to as the first, the second, the third, the fourth and the fifth circuits in indirect heat exchanging relationship with each other at each level of the said exchanger, the said circuits forming a unitary assembly, the first circuit being of the non-tortuous type and the fifth circuit being of the tortuous type, the first circuit being arranged at a higher level than the level of the fifth circuit, at least one direct junction between the top of the first circuit and the top of the second circuit, at least one connection through an expansion means between the top of the third circuit and the top of the fourth circuit, at least one phase separation zone connected with its upper part to the bottom of the first circuit, with its lower part to the bottom of the third circuit and sidewise to the top of the fifth circuit.

Preferably the first circuit is superposed upon the fifth circuit.

BRIEF DESCRIPTION OF DRAWINGS

The accompanying

DETAILED DESCRIPTION OF THE PREFERRED EMBODIMENTS

Figure 1:
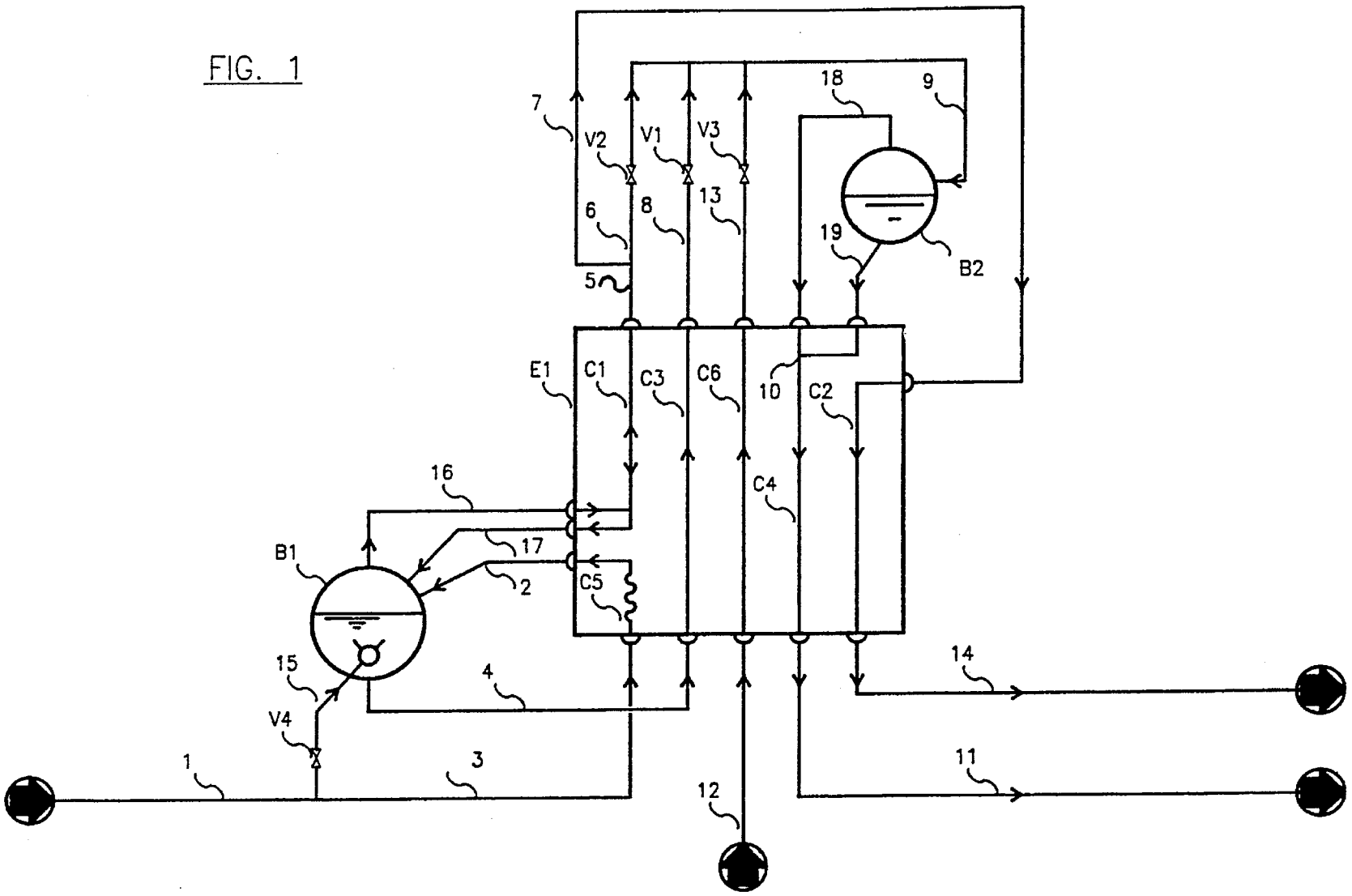
FIGS. 1 and 2 are illustrating the invention in a non-limiting manner.

The heat exchanger E1 comprises five main circuits C1 to C5 corresponding to the first, second, third, fourth and fifth circuits, respectively, of the method. The gas to be purified is conveyed through the lines 1 and 3 to the circuit C5 and flows out therefrom through the line 2 as a mixed gas/first condensate phase. Both phases separate from each other within the drum B1: the gaseous phase is fed through the line 16 to the circuit C1; it there undergoes a cooling and a second condensate is formed and flows back through the line 17. The non-condensed gas flows out at the head and is carried through the lines 5 and 7 to the circuit C2. It issues in a re-heated condition from the bottom of this circuit through the line 14. One thus obtains the purified gas or the lightest fraction of the batch load.

The condensates coming from the circuits C5 and C2 through the lines 2 and 17, respectively, are mixed together and carried by the line 4 to the circuit C3 where they undergo a sub-cooling. They issue from the head through the line 8, flow through the expansion valve V1 and are carried to the circuit C4 by the line 9. They may flow through a drum B2, in which case the gaseous phase and the liquid phase are carried to C4 by the lines 18 and 19, respectively, towards the point 10. The vaporized condensates flow out of the circuit C4 through the line 11. These are the least volatile fractions of the batch load.

According to a first alternative embodiment, one part of the gas issued from the circuit C1 is taken from the line 5 and fed through the expansion valve V2 and the line 6 to the drum B2.

According to the second alternative embodiment, one part of the initial gas is carried to the drum B1 through the line 15 and the valve V4.

According to the third alternative embodiment, a liquid phase compatible with the condensate in the line 4 is carried by the line 12 to an auxiliary circuit C6 to there undergo a sub-cooling before passing into the line 13 and the expansion valve V3 and being fed to the drum B2 preferably through the line 9.

Figure 2:
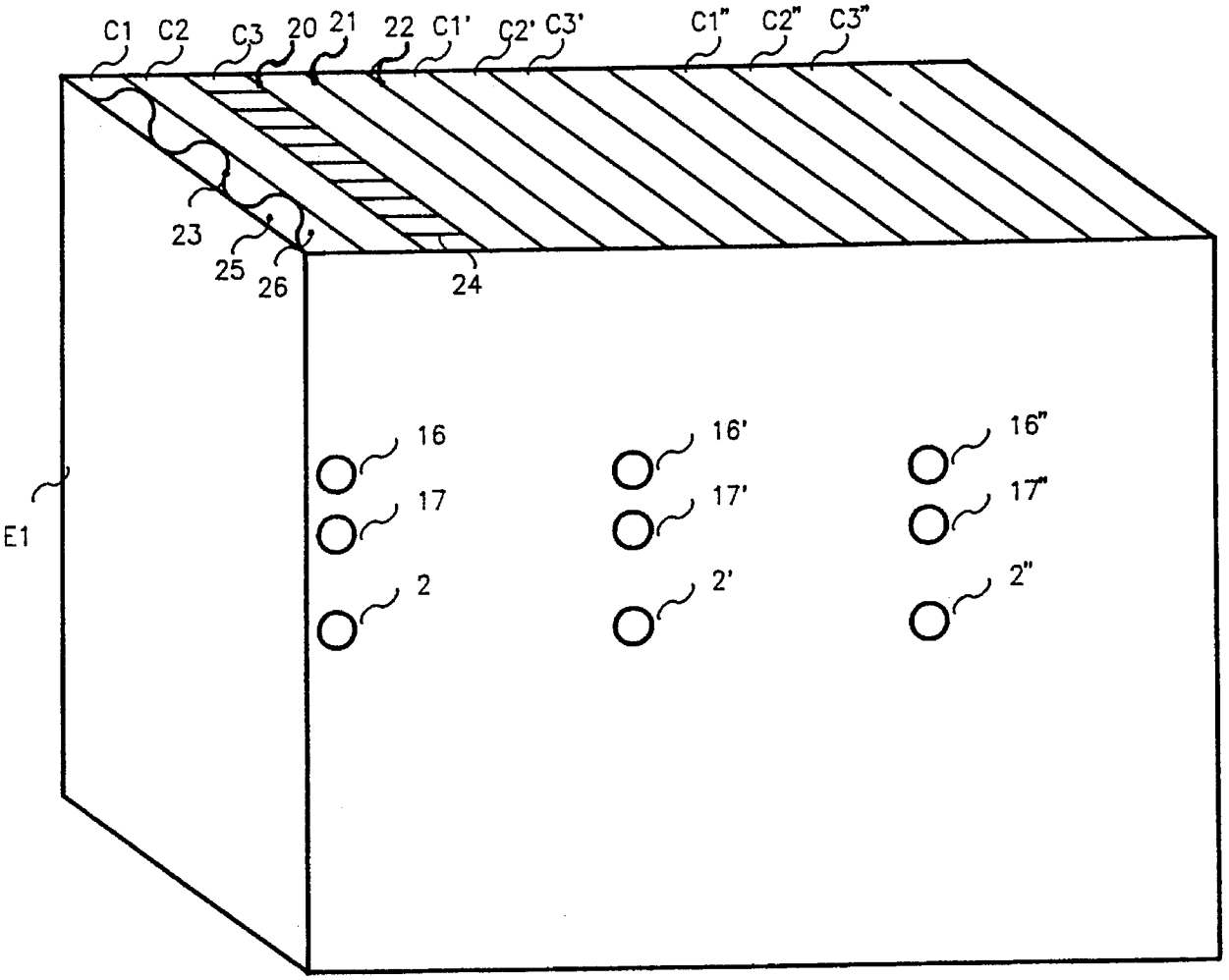

On FIG. 2 is again shown the unitary exchanger assembly E1 comprising a plurality of circuits performing the same function by groups. Thus the circuit C1 of FIG. 1 is subdivided into C1, C1' and C1", the circuit C2 is subdivided into C2, C2', and C2", etc. Each circuit is separated from the adjacent circuit by a vertical metal sheet such as the metal sheets 20, 21, 22, etc. Preferably each circuit is of the multi-channel type. The circuits C1 and C3 are examples thereof. There are indeed seen vertical metal sheets such as 23 (corrugated metal sheet) or 24 (flat partition) dividing the circuits into a plurality of elementary channels such as 25 and 26.

One again sees the sidewise arranged outlets of the channels 2, 16 and 17 pertaining to the fifth (2) and first (16 and 17) circuits of FIG. 1, together with their equivalents 2', 16', 17', 2", 16" and 17". The manifolds placed at the upper part and at the lower part of the exchanger E1 have not been shown since they are of a conventional type. For example one of the manifolds will gather the effluents from the circuits C1, C1' and C1", and likewise for C2, C2' and C2", etc. The lateral ducts 2, 16, 17 (and their equivalents designated by a dash and a double dash) are connected to distinct drums B1 or to a common elongate drum B1.

The order of succession of the circuits described hereinabove, namely C1, C2, C3, C4, C5 is not essential and any other combination may be contemplated. For example one could have the order C1, C4, C3, C2, C5 or C2, C4, C1, C3, C5, etc. . . it being understood that preferably C1 is superposed upon C5.

The following examples 1 to 4 given as being non-limiting illustrate the invention.

EXAMPLE 1

One processes a gas available at −93° C. under an absolute pressure of 35 bar. Its composition is given in Table 1. Its flow rate is 121.788 kmol/h.

The temperature and pressure conditions at the different points of the circuits are given in Table 5.

The valves V2, V3 and V4 are shut off.

One collects in the line 6, 111.703 kmol/h of gas enriched with hydrogen and including less than 1% by mole of ethylene under an absolute pressure of 34.7 bar and 10.086 kmol/h of a gas substantially enriched with ethylene in the line 12 under an absolute pressure of 1.8 bar. This latter gas may be carried to a distillation column to obtain a stream still richer in ethylene. The compositions of the streams of the equipment are stated in Table 1.

EXAMPLE 2

One operates as in the example 1 while however partially opening the valve V2 to permit the vaporization of the fluid circulating in the circuit 4 at a higher pressure.

The Tables 2 and 6 give the compositions of the fluids, respectively, at the inlet and at the outlet and the operating conditions.

EXAMPLE 3

One operates as in the example 2 with moreover a partial opening of the valve V4. The Tables 3 and 7 give the compositions of the fluids and the operating conditions.

EXAMPLE 4

One operates as in the example 3 with in addition a partial opening of the valve V3 permitting the introduction of a distillate consisting of a mixture of 50/50 by volume of methane and ethylene, obtained by rectifying the purified gas from an earlier operating step.

Such an operating mode is used during the start-up of the equipment to facilitate its putting in a cold state.

The Tables 4 and 8 give the compositions of the fluids and the operating conditions.

TABLE 1

| | | Gas to be purified (line 1) | Purified gas (line 14) | Separated gas (line 11) |
|---|---|---|---|---|
| Molar composition | | | | |
| Hydrogen | % by mole | 62.3100 | 67.7567 | 1.9871 |
| Carbon monoxide | % by mole | 0.3814 | 0.4073 | 0.0941 |
| Methane | % by mole | 31.3551 | 31.0198 | 35.0688 |
| Acetylene | % by mole | 0.0369 | 0.0013 | 0.4312 |
| Ethylene | % by mole | 5.4370 | 0.8057 | 56.7295 |
| Ethane | % by mole | 0.4784 | 0.0092 | 5.6743 |
| Propylene | % by mole | 0.0012 | 0.0000 | 0.0149 |
| Temperature | °C. | −93.00 | −95.00 | −100.00 |
| Pressure | bar abs. | 35.00 | 34.70 | 1.80 |
| Molar flow rate | kmol/h | 121.788 | 111.703 | 10.086 |

TABLE 2

| | | Gas to be purified (line 1) | Purified gas (line 14) | Separated gas (line 11) |
|---|---|---|---|---|
| Molar composition | | | | |
| Hydrogen | % by mole | 62.3100 | 67.7566 | 12.8710 |
| Carbon monoxide | % by mole | 0.3814 | 0.4073 | 0.1460 |
| Methane | % by mole | 31.3551 | 31.0198 | 34.3984 |
| Acetylene | % by mole | 0.0369 | 0.0013 | 0.3600 |
| Ethylene | % by mole | 5.4370 | 0.8057 | 47.4753 |
| Ethane | % by mole | 0.4784 | 0.0092 | 4.7369 |
| Propylene | % by mole | 0.0012 | 0.0000 | 0.0124 |
| Temperature | °C. | −93.00 | −95.00 | −98.30 |
| Pressure | bar abs. | 35.00 | 34.70 | 2.40 |
| Molar flow rate | kmol/h | 121.788 | 109.703 | 12.086 |

TABLE 3

| | | Gas to be purified (line 1) | Purified gas (line 14) | Separated gas (line 11) |
|---|---|---|---|---|
| Molar composition | | | | |
| Hydrogen | % by mole | 62.3100 | 67.4592 | 18.7556 |
| Carbon monoxide | % by mole | 0.3814 | 0.4066 | 0.1682 |
| Methane | % by mole | 31.3551 | 31.3225 | 31.6311 |
| Acetylene | % by mole | 0.0369 | 0.0012 | 0.3385 |
| Ethylene | % by mole | 5.4370 | 0.8021 | 44.6420 |
| Ethane | % by mole | 0.4784 | 0.0085 | 4.4529 |
| Propylene | % by mole | 0.0012 | 0.0000 | 0.0116 |
| Temperature | °C. | −93.00 | −95.00 | −99.39 |
| Pressure | bar abs. | 35.00 | 34.70 | 2.40 |
| Molar flow rate | kmol/h | 121.788 | 108.912 | 12.876 |

TABLE 4

| | | Gas to be purified (line 1) | Purified gas (line 14) | Separated gas (line 11) | Distillate (line 12) |
|---|---|---|---|---|---|
| Molar composition | | | | | |
| Hydrogen | % by mole | 62.3100 | 67.4592 | 9.1827 | 0.0000 |
| Carbon monoxide | % by mole | 0.3814 | 0.4066 | 0.1097 | 0.0000 |
| Methane | % by mole | 31.3551 | 31.3225 | 34.4823 | 50.0000 |
| Acetylene | % by mole | 0.0369 | 0.0012 | 0.3332 | 0.0000 |

TABLE 4-continued

| | | Gas to be purified (line 1) | Purified gas (line 14) | Separated gas (line 11) | Distillate (line 12) |
|---|---|---|---|---|---|
| Ethylene | % by mole | 5.4370 | 0.8021 | 51.4970 | 50.0000 |
| Ethane | % by mole | 0.4784 | 0.0085 | 4.3836 | 0.0000 |
| Propylene | % by mole | 0.0012 | 0.0000 | 0.0115 | 0.0000 |
| Temperature | °C. | −93.00 | −95.00 | −99.19 | −92.00 |
| Pressure | bar abs. | 35.00 | 34.70 | 2.40 | 17.80 |
| Molar flow rate | kmol/h | 121.788 | 108.912 | 13.076 | 2.000 |

TABLE 5

| Designation | Flux n° | Temperature °C. | Pressure bar abs. | Flow rate kmol/h |
|---|---|---|---|---|
| Gas to be purified | 1 | −93.00 | 35.00 | 121.788 |
| Refrigerated gas to be purified | 2 | −100.00 | 34.90 | 121.788 |
| Gas to be purified feeding E1 | 3 | −93.00 | 35.00 | 121.788 |
| Liquid of B1 | 4 | −101.47 | 34.90 | 10.086 |
| Purified gas | 5 | −120.35 | 34.80 | 111.703 |
| Purified gas injected into B2 | 6 | −120.35 | 34.80 | 0.000 |
| Purified gas reinjected into E1 | 7 | −120.35 | 34.80 | 111.703 |
| Refrigerated liquid of B1 | 8 | −120.00 | 34.80 | 10.086 |
| Feed to B2 | 9 | −136.57 | 1.90 | 10.086 |
| Purified gas | 10 | −136.57 | 1.90 | 10.086 |
| Re-heated purified gas | 11 | −100.00 | 1.80 | 10.086 |
| Distillate | 12 | | | 0.000 |
| Refrigerated distillate | 13 | | | 0.000 |
| Re-heated purified gas | 14 | −95.00 | 34.70 | 111.703 |
| Gas to be purified injected into B1 | 15 | −93.00 | 35.00 | 0.000 |

TABLE 6

| Designation | Flux n° | Temperature °C. | Pressure bar abs. | Flow rate kmol/h |
|---|---|---|---|---|
| Gas to be purified | 1 | −93.00 | 35.00 | 121.788 |
| Refrigerated gas to be purified | 2 | −100.00 | 34.90 | 121.788 |
| Gas to be purified feeding E1 | 3 | −93.00 | 35.00 | 121.788 |
| Liquid of B1 | 4 | −101.47 | 34.90 | 10.086 |
| Purified gas | 5 | −120.35 | 34.80 | 111.703 |
| Purified gas injected into B2 | 6 | −120.35 | 34.80 | 0.000 |
| Purified gas reinjected into E1 | 7 | −120.35 | 34.80 | 111.703 |
| Refrigerated liquid of B1 | 8 | −120.00 | 34.80 | 10.086 |
| Feed to B2 | 9 | −136.57 | 2.50 | 12.086 |
| Purified gas | 10 | −136.57 | 2.50 | 12.086 |

TABLE 6-continued

| Designation | Flux n° | Temperature °C. | Pressure bar abs. | Flow rate kmol/h |
|---|---|---|---|---|
| Re-heated purified gas | 11 | −100.00 | 2.40 | 12.086 |
| Distillate | 12 | | | 0.000 |
| Refrigerated distillate | 13 | | | 0.000 |
| Re-heated purified gas | 14 | −95.00 | 34.70 | 109.703 |
| Gas to be purified injected into B1 | 15 | −93.00 | 35.00 | 0.000 |

TABLE 7

| Designation | Flux n° | Temperature °C. | Pressure bar abs. | Flow rate kmol/h |
|---|---|---|---|---|
| Gas to be purified | 1 | −93.00 | 35.00 | 121.788 |
| Refrigerated gas to be purified | 2 | −100.00 | 34.90 | 101.788 |
| Gas to be purified feeding E1 | 3 | −93.00 | 35.00 | 101.788 |
| Liquid of B1 | 4 | −96.75 | 34.90 | 9.576 |
| Purified gas | 5 | −120.30 | 34.80 | 112.212 |
| Purified gas injected into B2 | 6 | −120.30 | 34.80 | 3.300 |
| Purified gas reinjected into E1 | 7 | −120.30 | 34.80 | 108.912 |
| Refrigerated liquid of B1 | 8 | −120.00 | 34.80 | 9.576 |
| Feed to B2 | 9 | −137.56 | 2.50 | 12.876 |
| Purified gas | 10 | −137.56 | 2.50 | 12.876 |
| Re-heated purified gas | 11 | −99.39 | 2.40 | 12.876 |
| Distillate | 12 | | | 0.000 |
| Refrigerated distillate | 13 | | | 0.000 |
| Re-heated purified gas | 14 | −95.00 | 34.70 | 108.912 |
| Gas to be purified injected into B1 | 15 | −93.00 | 35.00 | 20.000 |

TABLE 8

| Designation | Flux n° | Temperature °C. | Pressure bar abs. | Flow rate kmol/h |
|---|---|---|---|---|
| Gas to be purified | 1 | −93.00 | 35.00 | 121.788 |

TABLE 8-continued

| Designation | Flux n° | Temperature °C. | Pressure bar abs. | Flow rate kmol/h |
|---|---|---|---|---|
| Refrigerated gas to be purified | 2 | −100.00 | 34.90 | 101.788 |
| Gas to be purified feeding E1 | 3 | −93.00 | 35.00 | 101.788 |
| Liquid of B1 | 4 | −96.75 | 34.90 | 9.576 |
| Purified gas | 5 | −120.30 | 34.80 | 112.212 |
| Purified gas injected into B2 | 6 | −120.30 | 34.80 | 1.500 |
| Purified gas reinjected into E1 | 7 | −120.30 | 34.80 | 110.712 |
| Refrigerated liquid of B1 | 8 | −120.00 | 34.80 | 9.576 |
| Feed to B2 | 9 | −137.56 | 2.50 | 13.076 |
| Purified gas | 10 | −136.87 | 2.50 | 13.076 |
| Re-heated purified gas | 11 | −99.19 | 2.40 | 13.076 |
| Distillate | 12 | −92.00 | 17.76 | 2.000 |
| Refrigerated distillate | 13 | −120.000 | 17.66 | 2.000 |
| Re-heated purified gas | 14 | −95.00 | 34.70 | 110.712 |
| Gas to be purified injected into B1 | 15 | −93.00 | 35.00 | 20.000 |

What is claimed is:

1. A self-refrigerated method for the cryogenic fractionation and purification of a gaseous feed fluid with at least two components condensable at different condensation temperatures, namely at least one relatively heavy component to be removed and at least one relatively light component to be recovered so as to produce a purified gas preferably comprising the relatively light component(s) and a separated gas preferably comprising the relatively heavy component(s), wherein the improvement consists in the steps of: operating in a heat exchange zone forming a unitary assembly and comprising at least five distinct aggregately vertical circuits referred to as the first, second, third, fourth and fifth circuits, respectively, in indirect heat exchanging relationship with each other at each level of the heat exchange zone, the first circuit or reflux circuit being essentially arranged in an upper relatively colder portion of the heat exchange zone and the fifth circuit being essentially arranged in a lower and relatively less cold portion of the heat exchange zone, which method comprises circulating at least one fraction of the gaseous feed fluid aggregately from bottom to top in the fifth circuit under such conditions that it may condense in part to give a first condensate and that this first condensate be carried along without any substantial reflux by the said gaseous fluid, discharging the resulting mixture of non-condensed gas and of the first condensate from the top of the fifth circuit, separating the said non-condensed gas from the said first condensate in a phase separation zone, causing the gas thus separated to circulate aggregately from bottom to top in the first circuit or reflux circuit under such conditions that one part of the gas may give a second condensate and that this second condensate may flow back into the said first circuit and be collected at its bottom, causing at least one part of the non-condensed gas discharged from the top of the first circuit to circulate aggregately from top to bottom in the second circuit in counter-current relationship with the fluid circulating in the first circuit and then with the fluid circulating in the fifth circuit and discharging the resulting purified gas, causing the first condensate and the second condensate to circulate aggregately from bottom to top in the third circuit to there undergo a sub-cooling, discharging from the top of the third circuit the resulting sub-cooled first and second condensates, expanding them and causing them to circulate aggregately from top to bottom in the fourth circuit where they vaporize by taking heat from the fluids of the first, third and fifth circuits, at last discharging the said vaporized condensates from the bottom of the fourth circuit, these vaporized condensates constituting the separated gas.

2. A method according to claim 1, wherein one operates under such conditions that the purified gas includes less than 1% by mole of the relatively heavy components and that the separated gas includes at least 30% by mole of the said relatively heavy components.

3. A method according to claim 1 or 2, wherein a fraction of 90% to 98% by mole of the non-condensed gas, discharged from the top of the first circuit, is caused to circulate in the second circuit and another fraction of the said gas representing from 2% to 10% by mole of the said non-condensed gas is expanded and caused to circulate after expansion in the heat exchange zone in the direction aggregately from top to bottom as a mixture with the first condensate or the second condensate or with both of them to thereby permit a vaporization at a higher pressure of the said condensate(s).

4. A method according to claim 1, wherein a fraction of 5% to 20% by mole of the gaseous feed fluid does not flow through the fifth circuit and is conveyed directly into the said phase separation zone.

5. A method according to claim 4, wherein one varies the gaseous feed fluid portion carried directly to the phase separation zone in response to the variations of composition of the said gaseous feed fluid so as to maximize the amount of purified gas obtained from the second circuit.

6. A method according to claim 1, further consisting in providing a supply of liquid phase of external origin to the heat exchange zone during the start of the equipment to facilitate its being put in a cold condition under conditions where this liquid phase may evaporate after expansion and flow through the heat exchange zone from top to bottom.

7. A method according to claim 1, further consisting in condensing 2% to 20% by mole of the gaseous feed fluid in the fifth circuit.

8. A heat exchanger permitting a self-refrigerated purification with reflux of a gas which comprises at least five distinct aggregately vertical circuits referred to as the first, second, third, fourth and fifth circuits, respectively, in indirect heat exchanging relationship with each other at each level of the said exchanger, the said circuits forming a unitary assembly, the first circuit being of the non-tortuous type and the fifth circuit being of the tortuous type, the first circuit being arranged at a higher level than that of the fifth circuit, at least one direct junction between the top of the first circuit and the top of the second circuit, at least one junction through an expansion means between the top of the third circuit and the top of the fourth circuit, at least one phase separation zone connected with its upper portion to the bottom of the first circuit, with its lower portion to the bottom of the third circuit and sidewise to the top of the fifth circuit.

9. An exchanger according to claim 8, wherein the first circuit is superposed upon the fifth circuit.

10. An exchanger according to claim 8 or 9, wherein at least one part of the circuits is of the multi-channel type.

* * * * *